United States Patent [19]

Vona et al.

[11] Patent Number: 5,050,510

[45] Date of Patent: Sep. 24, 1991

[54] ALUMINUM CATCH TRAY SYSTEM

[75] Inventors: Frank D. Vona; James H. Rafferty, both of Erie, Pa.

[73] Assignee: Zurn Industries, Inc., Erie, Pa.

[21] Appl. No.: 471,605

[22] Filed: Jan. 29, 1990

[51] Int. Cl.[5] ..... F23G 5/00; F23G 5/44; F23H 11/18; F23H 11/24

[52] U.S. Cl. ..... 110/257; 110/255; 110/259; 110/271; 110/272

[58] Field of Search ..... 110/165 R; 166, 229, 110/247, 248, 255, 257, 259, 267, 268, 269, 270, 271, 328, 329, 272; 432/8, 59

[56] References Cited

U.S. PATENT DOCUMENTS

| | | | |
|---|---|---|---|
| 242,430 | 6/1881 | Butterfield | 110/166 |
| 1,659,564 | 2/1928 | Duncan | 110/257 X |
| 1,758,075 | 5/1930 | Duncan | 110/272 |
| 1,883,299 | 10/1932 | Kerr | 110/272 |
| 1,887,153 | 11/1932 | Grohn . | |
| 1,894,170 | 1/1933 | Glaenzer | 110/166 |
| 1,898,479 | 2/1933 | Coghlan et al. | 110/272 |
| 2,271,967 | 2/1942 | Beers | 110/271 |
| 2,771,847 | 11/1956 | Holbrook | 110/257 |
| 2,862,463 | 12/1958 | Duncan | 110/257 X |
| 2,936,725 | 5/1960 | Blundin et al. | 110/271 |
| 3,302,597 | 2/1967 | Godel | 110/271 |
| 3,946,680 | 3/1976 | Laman | 110/257 |
| 4,419,940 | 12/1983 | Cosar et al. | 110/229 |
| 4,446,800 | 5/1984 | Lövgren | 110/257 X |
| 4,592,289 | 6/1986 | Pershing et al. | 110/257 X |
| 4,831,940 | 5/1989 | Franza | 110/165 R X |

FOREIGN PATENT DOCUMENTS

| | | | |
|---|---|---|---|
| 2605385 | 10/1986 | France | 110/166 |

*Primary Examiner*—Henry A. Bennet
*Assistant Examiner*—Christopher B. Kilner
*Attorney, Agent, or Firm*—Wayne L. Lovercheck; Charles L. Lovercheck; Dale Lovercheck

[57] ABSTRACT

An apparatus and method of burning trash containing aluminum in a furnace having a moving grate and inclined trays. The grate has an upper and lower part. The inclined trays are provided with one or more inclined plates. The inclined plates are supported on the trays below the upper part of the grate and above the lower part of the grate. Ash and molten aluminum falls through the upper part of the grate, onto the inclined plates, the ash slides off the plates and the aluminum remains on the plates. The plates have holes therethrough to allow air flow for combustion. Some blockage of the holes by aluminum will result over time, but not enough to significantly restrict the flow of combustion air to the combustion area. The trays are removed through the side walls of the furnace for removal of the aluminum when necessary.

20 Claims, 3 Drawing Sheets

ALUMINUM CATCH TRAY SYSTEM

BACKGROUND OF THE INVENTION

This invention relates to a system and method of burning fuel in the form of a combustable mixture which contains some tramp aluminum, for example, waste aluminum such as foil or cans. The fuel containing aluminum, for example, household refuse containing aluminum cans is supported on an upper part of a moving grate as it moves through the combustion area of a furnace. The moving grate returns from a downstream end to an upstream end through a lower part located below the combustion area.

In stokers with traveling grates, where trash and garbage are included in the fuel, aluminum cans and other waste aluminum are inevitably present in the fuel. The aluminum melts as the fuel is burned, drips through the grate and, if not intercepted, the falling aluminum will adhere itself to the backside of the returning grate. As the furnace continues to burn, aluminum will continue to build up on the backside of the returning grate as it passes under the combustion area. The aluminum build-up will continue until the grate mechanism jams. The jammed grate must then be scraped clean which requires time and effort and occasions the loss of the furnace output for a period of time.

STATEMENT OF PRIOR ART

Applicant is aware of the following prior art patents:

U.S. Pat. No. 1,887,153 to Grohn

U.S. Pat. No. 4,419,940 to Cosar

The problems of the prior art are overcome by the improved system and method of combusting fuel which contains tramp aluminum of the present invention. The improvements of the present invention beneficially provide a novel, non-obvious and useful manner of capturing melted aluminum and preventing it from building up on the backside of a moving grate.

STATEMENT OF INVENTION

To avoid stopping the furnace to clean the grate, trays are provided between the upper grate portion and the lower grate portion to intercept the molten aluminum after it drips through the upper grate portion and before it adheres to the lower grate portion. The trays are supported between the upper and lower run of the belt and may be made up of plates that are inclined to the horizontal. The plates may also have an array of holes distributed across their surface to permit the passage of combustion air to the under side of the upper portion of grate supporting the burning fuel. The incline of the plates will provide for the deflection or shedding of the ashes from the plates. By shedding all or most of the ash, the plates will not fill up as quickly as they would otherwise would from the relatively large volume of falling ash and will continue to permit the passage of combustion air while intercepting the relatively small volume of molten aluminum.

The trays are replaceable to reduce shutdown time. One set can be taken out and replaced by a second set of trays and the furnace may then be run while the used set of trays is being cleaned.

In a preferred embodiment of the invention the planes of two planar perforated plates of each tray intersect at an acute angle to a vertical axis sufficient to substantially deflect ashes from the plates. Ash falling from the grate is deflected by the plates into an ash pit positioned below the trays and below the lower portion of the grate.

The improvements of this invention each taken alone or in combination add to solve the problems of the prior art.

It is an object of the invention to provide a method of and system for combustion of an aluminum containing combustable material on a grate using a grid of catch trays which include perforated plates positioned to intercept molten aluminum falling from the combustion area.

Another object of the invention is to provide a method of and system for combustion of an aluminum containing combustable mixture on a grate using a grid of catch trays which include perforated plates inclined to substantially deflect or shed ash from the plate.

Another object of the invention is to provide a method of and system for combustion of an aluminum containing combustable material using a grid of catch trays having a pair of planar deflecting plates the planes of which intersect at an angle sufficient to substantially deflect or shed ash from the plates.

Another object of the invention is to provide a method of and system for replacing the planar deflecting plates using a grid of catch trays supported on wheels.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE INVENTION

A method of and system for combustion of an aluminum containing combustable material on a moving grate using a grid of trays is disclosed. The moving grate has an upper part and a lower part. The combustable mixture is supported on and moved by the upper part of the moving grate which provides a combustion area. An array or gird of trays is disposed substantially contiguous with the combustion area below the upper part of the moving grate and above the lower part of the moving grate to intercept falling drips of aluminum to prevent the adherence of the aluminum to the lower part of the grate.

The trays each consist of an inclined plate having an upwardly facing surface, and a supporting frame. The frame may be provided with wheels which will permit the trays to be moved into and out of the furnace. The plates may also be provided with holes to permit combustion air to pass to the underside of the combustion area.

In a preferred embodiment, each tray includes at least two pairs of spaced screens, (each pair of screens being arranged in the form of an inverted "V"). Each plate may be provided with spaced holes approximately one half inch in diameter and occupying about half of the area of the plate. The plates are positioned to substantially deflect ash falling from the upper part of the moving grate. The ash will slide off of the plates onto the returning lower part of the grate and therethrough into the ash receptacle. The aluminum will melt from the heat of combustion, and will fall onto the array of trays where it will solidify immediately. Some blockage of the holes from the upper part of the grate in the plates will occur, but not enough to effect the passage of combustion air therethrough. The trays are supported on wheels which are positioned on rails. The rails are positioned so that the trays may be rolled from under the grate for cleaning, repair and replacement.

The perforated plates of the present invention permit fresh air for combustion to pass up into the combustion area and the incline of the plates will shed ash. Due to the inverted shape, the aluminum will splatter on the inverted tray and immediately adhere thereto. Ash will shed down the slope and fall into the ash pit. These inverted trays are replaceable to reduce shutdown time in that one set may be taken out and replaced by a second set and the boiler restarted while the used set of trays is cleaned.

DETAILED DESCRIPTION OF THE PREFERRED EMBODIMENT

Figure 1:
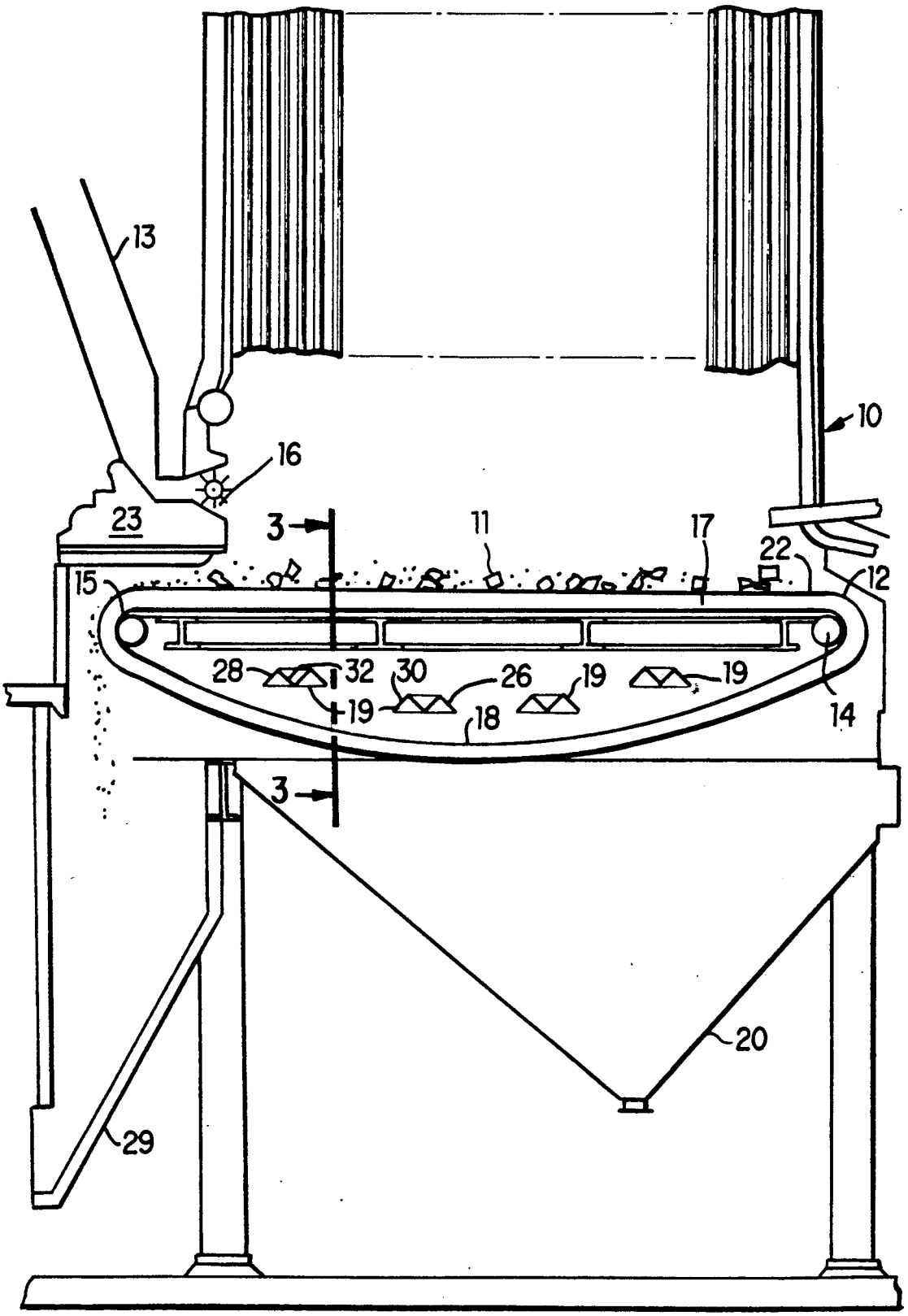
FIG. 1 is a schematic view of a furnace in accordance with the invention.

The preferred embodiment of the invention is illustrated by way of example in FIGS. 1 through 5. Referring to the Figures, in which like numerals refer to like portions thereof FIG. 1 shows furnace 10 in accordance with the present invention for burning fuel mixture 11 which contains some tramp aluminum, for example, household trash. Furnace 10 includes moving grate 12 which revolves around rollers 14 and 15. Grate 12 moves through upper part 17 in which the grate supports the fuel mixture during combustion and returns through lower part 18 as moving grate 12 revolves around the rollers. Moving grate 12 has upstream end 22 at a first end of upper part 17 and downstream end 23 at a second end of upper part 17. Fuel mixture 11 is fed through duct 13 to stoker 16 which distributes fuel mixture 11 onto grate 12. Air from below grate 12 may pass therethrough to maintain the combustion of the fuel mixture 11. Inclined trays 19 having inclined plates 24 are supported between upper part 17 and lower part 18 of grate 12. As grate 12 moves fuel mixture 11 during combustion over trays 19 the aluminum in fuel mixture 11 melts. Molten aluminum and ash pass through grate 12 onto the inclined plates of trays 19, the ash slides off of inclined plates 24 and then falls into bin 20. The molten aluminum falls on the trays and solidifies immediately. If the relatively large volume of ash is not shed from the trays, the trays will quickly fill to the point where combustion air is reduced. The trays may be provided with holes therethrough for the passage of combustion air. Some blockage of the holes in the trays will occur over time, but not enough to adversely affect the operation of the furnace. Any ash or fuel mixture on grate 12 as it passes around roller 15 will drop into bin 29.

Figure 5:
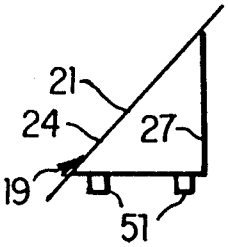
FIG. 5 is a partial end view of one embodiment of the tray according to the invention.
Figure 3:
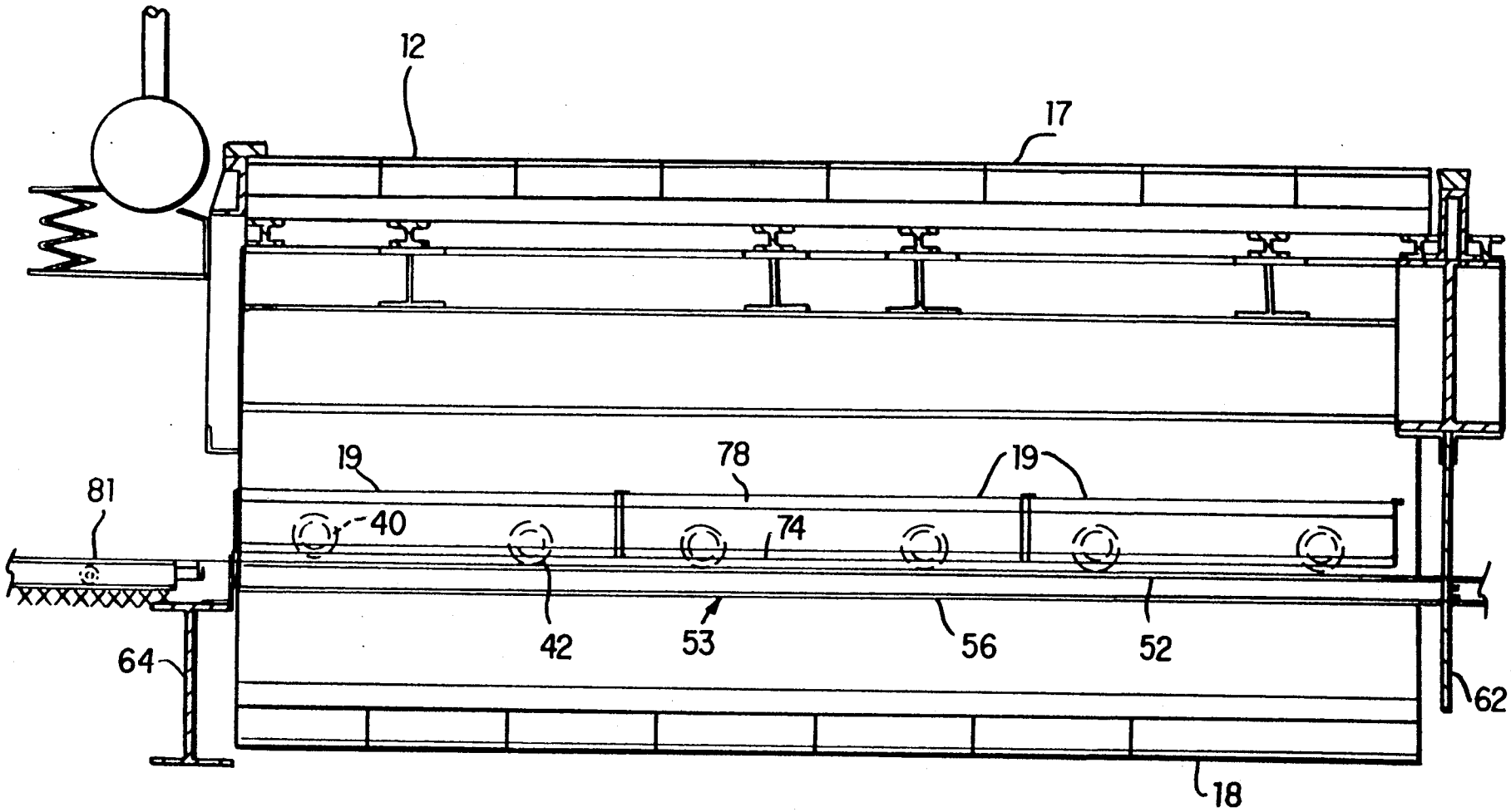
FIG. 3 is a partial lateral cross-sectional view of the furnace shown in FIG. 1.

With particular reference to FIG. 5, inclined tray 19 has inclined plate 24 having upwardly facing surface 21 supported at an acute angle to the vertical. Inclined plate 24 is supported by tray frame 27 and may be movably supported by tray support means 51.

Figure 2:
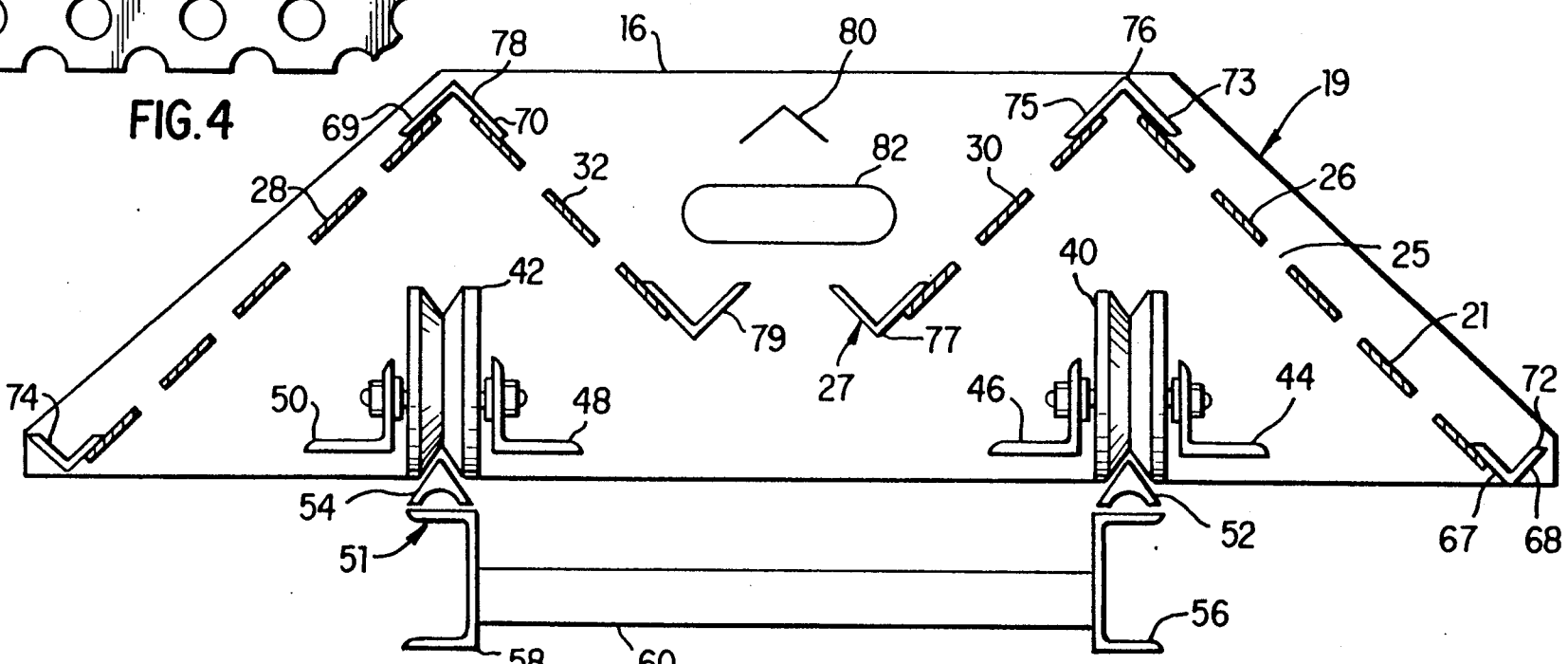
FIG. 2 is a enlarged partial view of a tray of FIG. 1 with one end removed.
Figure 4:
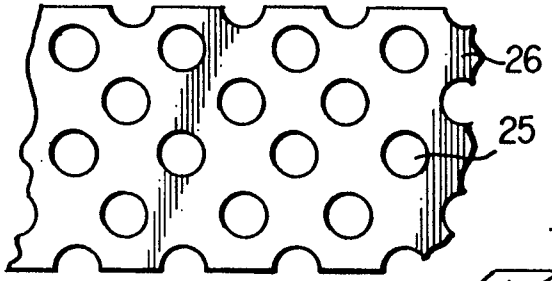
FIG. 4 shows an enlarged partial top view of one of the plates with holes therethrough according to the invention.

In a preferred embodiment and with more particular reference to FIG. 2 it is seen that each inclined tray 19 includes outer plates 26 and 28, and inner plates 30 and 32. Plates 26, 28, 30 and 32 may each be made of relatively thin sheet material. The plates may also be provided with spaced holes 25 that may be about one half inch in diameter and spaced from one another such that spaced holes 25 occupy about half of the area of plates 26, 28, 30 and 32. Inclined tray 19 is supported on wheels 40 and 42 which are connected to tray 19 by brackets 44 and 46 and brackets 48 and 50. Rails 52 and 54 support wheels 40 and 42 respectively. Rails 52 and 54 are supported on the furnace at side 62 and side 64 by channels 56 and 58 respectively. Cross member 60 connects channels 56 and 58 together.

Plates 26, 28, 30 and 32 are supported on trays 19 by tray frame 27, which may be angle sections. First angle section 76 has first flange 73 and second flange 75 and extends the length of tray 19. First angle section 76 is attached to the upper ends of inclined plates 26 and 30. Second angle section 78 has first flange 69 and second flange 70 and extends the length of tray 19. Section angle section 78 is attached to the upper ends of inclined plates 28 and 32. Third angle section 72 is attached to the lower end of plate 26 and has first flange 67 and second flange 68. Fourth angle section 74 is attached to the lower end of plate 28. Fifth angle section 77 is attached to the lower end of plate 30. Sixth angle section 79 is attached to the lower end of plate 32. Seventh angle section 80 extends across tray 19 at a point between plates 30 and 32 and intercepts any molten aluminum that falls between plates 30 and 32.

Inclined trays 19 may be movably supported on wheels 42 which engage tray support means 51. Tray support means 51 may consist of rails 52 and 54 supported on channels 56 and 58, and cross members 60 which position the channels relative to one another.

When inclined trays 19 become loaded with aluminum, inclined trays 19 can be rolled out of furnace 10 onto tracks 81 where they can be cleaned and rolled back beneath grate 12. Tracks 81 is supported by furnace frame 64.

OPERATION

In operation an aluminum containing combustable mixture, such as is commonly collected as residential trash, is continuously distributed over the upper portion of a rotating grate. The fuel burns using air supplied from beneath the grate. The aluminum melts and falls through the grate onto the plates of the trays positioned beneath the upper portion of a rotating grate.

The aluminum solidifies on the plates almost immediately. Some blockage of the perforations of the screens may occur, but not enough to adversely affect the performance of the furnace. The ash slides off of the plates into the ash bin.

The trays may be removed and cleaned as necessary. Replacement trays may be used while the inclined trays are being cleaned for continuous operation.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination a furnace for burning solid fuel containing tramp aluminum, a moving grate moving continuously from an upstream end to a downstream end and inclined trays, said grate having an upper part extending between said upstream end and said downstream end and providing a combustion area in which fuel may be burned, said grate having a lower part through which said grate returns from said downstream end to said upstream end, tray support means on said furnace supporting said inclined trays between said upper part of said moving grate and said lower part of said moving grate.

means for removing and replacing said inclined trays in said furnace, said inclined trays having an inclined plate having an upwardly facing surface inclined at an acute angle to the vertical whereby molten aluminum falling through said upper part of said moving grate impinges on said upwardly facing surface of said inclined plate is cooled and adheres to said upwardly facing surface and ash falling through said moving grate impinges on said upwardly facing surface is shed downwardly therefrom by gravity, and said inclined trays may be removed from said furnace for cleaning aluminum therefrom and said inclined trays may be replaced in said furnace.

2. The combination recited in claim 1 wherein at least two said plates are supported on each said inclined tray.

3. The combination recited in claim 1 wherein at least two said plates are supported on each said inclined tray, said plates being disposed generally at right angles to one another.

4. The combination recited in claim 1 wherein at least two said plates are supported on each said inclined tray, said plates being disposed generally at right angles to one another in the form of an inverted "v", said plates having upper edges adjacent one another and diverging downwardly and away from one another.

5. The combination recited in claim 1 wherein at least four said plates are supported on each said inclined tray, said plates being spaced below and generally across the combustion area of said furnace, plate support means supporting said plates in pairs, each said pair of plates being made up of two plates disposed generally at right angles to one another in the configuration of an inverted "v", said plates of each said pair having upper edges adjacent one another and diverging downwardly and away from one another.

6. The combination recited in claim 4 further comprising plate support means, said plate support means comprising a first angle section having first and second flanges disposed at right angles to one another, one said plate being fixed to the first said flange of said first angle section, the other said plate being fixed to said second flange of said first angle section.

7. The combination recited in claim 5 wherein said plate support means comprises a first angle section having first and second flanges disposed at right angles to one another, said first angle section supporting said first pair of plates, one said plate being fixed to said first flange of said first angle section, the other said plate being fixed to said second flange of said first angle section, a second angle section having first and second flanges disposed at right angles to one another, said second angle section supporting said second pair of plates, one said plate being fixed to said first flange of said second angle section, the other plate being fixed to said second flange of said second angle section.

8. The combination recited in claim 1 wherein said plate has spaced holes therethrough.

9. The combination recited in claim 2 wherein said plates have spaced holes therethrough.

10. The combination recited in claim 5 wherein said plates have spaced holes therethrough.

11. A method of preventing aluminum from jamming a moving grate in a furnace for burning fuel containing aluminum, said moving grate having an upper part and a lower part, the steps of said method comprising:

providing inclined trays having inclined plates between said upper part of said grate and said lower part of said moving grate, melting said aluminum as said fuel is burned, said melted aluminum falling through openings in said upper part of said moving grate, intercepting said melted aluminum with said inclined plates, removing said inclined trays, cleaning the aluminum from said inclined plates, and replacing said inclined trays in said furnace.

12. In combination a furnace having a moving grate for burning fuel containing aluminum and inclined trays for catching some of said aluminum comprising;

said moving grate having an upper part where fuel mixture is burned resulting in a relatively large volume of ash and a relatively small volume of molten aluminum falling from said upper part of said grate and a lower part spaced below said upper part, said inclined trays each comprising a tray frame, a first inclined plate and a second inclined plate, said first and said second inclined plates each having an upper edge and a lower edge, said upper edge of said inclined plates being connected together and said inclined plates diverging downwardly and outwardly at an acute angle of approximately 90 degrees to one another, said aluminum falls on said inclined plates cools and adheres to said inclined plates, said ash falling on said inclined plates and sliding off, whereby said ash will not accumulate on said tray and said aluminum will accumulate.

13. The combination recited in claim 12 wherein said frame of each said inclined tray comprises first angle section having a first flange and a second flange, said lower edge of each said first inclined plate is attached to said first flange of said first angle section, said second flange of said first angle section extending upwardly and at a right angle to said first flange.

14. The combination recited in claim 12 wherein said first and second plates have spaced openings therein, whereby combustion air may pass therethrough.

15. The combination recited in claim 13 wherein a second angle section is provided, said second angle section having a first flange and a second flange, said first flange of said second angle section being fixed to said upper edge of said first inclined plate, said second flange of said second angle section being fixed to said upper edge of said second inclined plate.

16. The combination recited in claim 12 wherein each said inclined tray has a third inclined plate and a fourth inclined plate, said third inclined plate and said fourth inclined plate each having an upper edge and a lower edge, said upper edge of said third inclined plate and said upper edge of said fourth inclined plate being fixed together, and said third inclined plate and said fourth inclined plate diverging downwardly and away from one another.

17. The combination recited in claim 16 wherein said first, second, third and fourth inclined plates have spaced openings therein whereby combustion air may pass therethrough.

18. The combination recited in claim 16 wherein a plurality of said inclined trays are supported in spaced relation to one another in said furnace below and generally coextensive with said upper part of said moving grate.

19. The combination recited in claim 18 wherein said inclined trays are supported on rail means in said furnace and track means are provided outside of said furnace whereby said inclined trays can be removed from said rail means in said furnace onto said track means outside of said furnace whereby said inclined trays may be cleaned and repaired outside of said furnace.

20. The combination recited in claim 1 wherein said inclined trays are supported on rail means in said furnace, and said inclined trays are supported on track means outside of said furnace whereby said inclined trays can be removed from said rail means in said furnace onto said track means outside of said furnace for cleaning said inclined trays.

* * * * *